US007505002B2

(12) United States Patent
Surittikul et al.

(10) Patent No.: US 7,505,002 B2
(45) Date of Patent: Mar. 17, 2009

(54) BEAM TILTING PATCH ANTENNA USING HIGHER ORDER RESONANCE MODE

(75) Inventors: Nuttawit Surittikul, Ann Arbor, MI (US); Kwan-ho Lee, Ann Arbor, MI (US); Wladimiro Villarroel, Worthington, OH (US)

(73) Assignee: AGC Automotive Americas R&D, Inc., Ypsilanti, MI (US)

( * ) Notice: Subject to any disclaimer, the term of this patent is extended or adjusted under 35 U.S.C. 154(b) by 188 days.

(21) Appl. No.: 11/739,889

(22) Filed: Apr. 25, 2007

(65) Prior Publication Data

US 2008/0129636 A1 Jun. 5, 2008

Related U.S. Application Data

(60) Provisional application No. 60/868,436, filed on Dec. 4, 2006.

(51) Int. Cl.
*H01Q 1/38* (2006.01)

(52) U.S. Cl. ..... 343/700 MS; 343/713; 343/858

(58) Field of Classification Search ..... 343/700 MS, 343/713, 858, 711, 846
See application file for complete search history.

(56) References Cited

U.S. PATENT DOCUMENTS 3,877,030 A 4/1975 Walker et al.
3,972,050 A 7/1976 Kaloi
4,242,685 A * 12/1980 Sanford ..... 343/770
4,575,725 A * 3/1986 Tresselt ..... 343/700 MS
4,749,996 A * 6/1988 Tresselt ..... 343/700 MS
4,803,494 A 2/1989 Norris et al.
4,887,089 A 12/1989 Shibata et al.
4,972,196 A 11/1990 Mayes
5,008,681 A 4/1991 Cavallaro et al.
5,220,335 A 6/1993 Huang
5,241,321 A * 8/1993 Tsao ..... 343/700 MS
5,243,353 A 9/1993 Nakahara
5,497,164 A 3/1996 Croq
5,515,057 A 5/1996 Lennen et al.
5,548,297 A 8/1996 Arai
5,568,155 A 10/1996 Tsunekawa et al.
5,714,961 A 2/1998 Kot et al.
5,896,108 A 4/1999 Shafai
5,966,096 A 10/1999 Brachat
5,977,710 A 11/1999 Kuramoto et al.
6,225,958 B1 5/2001 Amano et al.
6,236,367 B1 5/2001 Du Toit et al.
6,252,553 B1 6/2001 Solomon
6,452,548 B2 9/2002 Nagumo
6,483,465 B2 11/2002 Itoh et al.
6,498,588 B1 12/2002 Callaghan
6,597,316 B2 7/2003 Rao et al.

(Continued)

*Primary Examiner*—Tho G Phan
(74) *Attorney, Agent, or Firm*—Howard & Howard Attorneys PLLC

(57) ABSTRACT

A patch antenna receives circularly polarized RF signals from a satellite. The antenna includes a radiating element. A plurality of feed lines feed the radiating element at a plurality of feed points. The feed points are spaced apart to generate a circularly polarized radiation beam solely in a higher order mode at a desired frequency. The antenna may include a plurality of parasitic structures. The feed point spacing and/or the parasitic structures tilt the radiating beam away from an axis perpendicular to the radiating element. Thus, the patch antenna provides excellent RF signal reception from satellites at low elevation angles.

32 Claims, 6 Drawing Sheets

U.S. PATENT DOCUMENTS 6,759,990 B2 * 7/2004 Rossman ..... 343/700 MS
6,930,639 B2 8/2005 Bauregger et al.
6,999,030 B1 2/2006 Mateychuk
7,002,517 B2 2/2006 Noujeim
7,138,956 B2 11/2006 Nilsson
7,429,952 B2 * 9/2008 Sun ..... 343/700 MS
2001/0048390 A1 12/2001 Nagumo et al.
2001/0048392 A1 12/2001 Kawahata
2002/0014995 A1 2/2002 Roberts
2002/0036590 A1 3/2002 Itoh et al.
2002/0167446 A1 11/2002 Goto et al.
2003/0052825 A1 3/2003 Rao et al.
2003/0151550 A1 8/2003 Chen et al.
2003/0160722 A1 8/2003 Kwon et al.
2003/0189520 A1 10/2003 Goto et al.
2003/0214443 A1 11/2003 Bauregger et al.
2004/0004571 A1 1/2004 Adachi et al.
2004/0008140 A1 1/2004 Sengupta et al.
2004/0027288 A1 2/2004 Okubora et al.
2004/0090371 A1 5/2004 Rossman
2004/0130490 A1 7/2004 Jenabi
2004/0227667 A1 11/2004 Sievenpiper
2004/0246181 A1 12/2004 Fukushima et al.
2004/0257287 A1 12/2004 Fukushima
2005/0012675 A1 1/2005 Sakiyama
2005/0035910 A1 2/2005 Chiang et al.
2005/0083233 A1 4/2005 He et al.
2005/0093746 A1 5/2005 Diament
2005/0110681 A1 5/2005 Londre
2005/0116863 A1 6/2005 Yuanzhu
2005/0122266 A1 6/2005 Chang et al.
2005/0151687 A1 7/2005 Poe et al.
2005/0151698 A1 7/2005 Mohamadi
2005/0206568 A1 9/2005 Phillips et al.
2005/0243005 A1 11/2005 Rafi et al.
2006/0007044 A1 1/2006 Crouch
2006/0071870 A1 4/2006 Saito et al.

* cited by examiner

BEAM TILTING PATCH ANTENNA USING HIGHER ORDER RESONANCE MODE

CROSS REFERENCE TO RELATED APPLICATION

This application claims the benefit of U.S. Provisional Application No. 60/868,436, filed Dec. 4, 2006.

BACKGROUND OF THE INVENTION

1. Field of the Invention

The subject invention relates generally to a patch antenna. Specifically, the subject invention relates to a patch antenna for receiving circularly-polarized radio frequency signals from a satellite.

2. Description of the Related Art

Satellite Digital Audio Radio Service (SDARS) providers use satellites to broadcast RF signals, particularly circularly polarized RF signals, back to receiving antennas on Earth. The elevation angle between a satellite and an antenna is variable depending on the location of the satellite and the location of the antenna. Within the continental United States, this elevation angle may be as low as 20° from the horizon. Accordingly, specifications of the SDARS providers require a relatively high gain at elevation angles as low as 20° from the horizon.

SDARS reception is primarily desired in vehicles. SDARS compliant antennas are frequently bulky, obtuse-looking devices mounted on a roof of a vehicle. SDARS compliant patch antennas typically have a square-shaped radiating element with sides about equal to ½ of the effective wavelength of the SDARS RF signal. When the radiating element is disposed on a window of the vehicle, this large "footprint" often obstructs the view of the driver. Therefore, these patch antennas are not typically disposed on the windows of the vehicle.

However, even when these patch antennas are disposed on the windows of the vehicle, certain parts of the vehicle, such as a roof, may block RF signals and prevent the RF signals from reaching the antenna at certain elevation angles. Even if the roof does not block the RF signals, the roof may mitigate the RF signals, which may cause the RF signal to degrade to an unacceptable quality. When this happens, the antenna is unable to receive the RF signals at those elevation angles and the antenna is unable to maintain its intrinsic radiation pattern characteristic. Thus, antenna performance is severely affected by the roof obstructing reception of the RF signals, especially for elevation angles below 30 degrees. In order to overcome this, a radiation beam tilting technique can be used to compensate for signal mitigation caused by the vehicle body. Since antennas capable of receiving RF signals in SDARS frequency bands are typically physically smaller than those antennas receiving signals in lower frequency bands, it becomes challenging to tilt the antenna radiation main beam from the normal direction to the antenna plane, which is substantially parallel to the glass where the antenna is mounted.

Various patch antennas for receiving RF signals are well known in the art. Examples of such antennas are disclosed in the U.S. Pat. No. 4,887,089 (the '089 patent) to Shibata et al. and U.S. Pat. No. 6,252,553 (the '553 patent) to Soloman.

The '089 patent discloses a patch antenna having a radiating element. A first feed line and a second feed line are electrically connected to the radiating element at a first and second feed port, respectively. A switching mechanism connects a signal to either the first feed line or the second feed line. A horizontally polarized (i.e., linearly polarized) radiation beam is generated by the patch antenna in a higher order mode. However, the patch antenna of the '089 patent does not generate a circularly polarized radiation beam and is therefore of little value in the reception of circularly polarized RF signals broadcast from satellites.

The '553 patent also discloses a patch antenna having a radiating element. The antenna includes a plurality of feed lines electrically connected to the radiating element at a plurality of feed ports. The antenna also includes at least one phase shift circuit to shift a base signal and produce at least one phase-shifted electromagnetic signal. A circularly polarized radiating beam is generated by the patch antenna in both a fundamental mode and a higher order mode. The patch antenna of the '553 patent does not generate the circularly polarized radiation beam solely in a higher order mode. As such, the radiating element of the patch antenna of the '553 patent defines a large "footprint".

There remains an opportunity to introduce a patch antenna that aids in the reception of a circularly polarized RF signal from a satellite at a low elevation, especially when the patch antenna is disposed on an angled pane of glass, such as the window of a vehicle. There also remains an opportunity to introduce a patch antenna which significantly reduces the required "footprint" of the antenna's radiating element when compared to other prior art patch antennas. There further remains an opportunity to introduce a patch antenna that can overcome interference caused by a roof of the vehicle.

SUMMARY OF THE INVENTION AND ADVANTAGES

The invention provides a patch antenna including a radiating element formed of a conductive material. A plurality of feed lines is electrically connected to the radiating element at a plurality of feed ports. At least one phase shift circuit is electrically connected to at least one of the plurality of feed lines for phase shifting a base signal to achieve a phase-shifted signal. The feed ports are spaced apart from one another such that the radiating element is excitable to generate a circularly polarized radiation beam solely in a higher order mode at a desired frequency.

By generating the circularly polarized radiation beam solely in a higher order mode, the maximum gain of the radiation beam is tilted away from an axis perpendicular to the radiating element. This tilting-effect is very beneficial when attempting to receive the circularly polarized RF signals from a satellite at a low elevation angle. Furthermore, the dimensions of the radiating element are much smaller than many prior art radiating elements. This is very desirous to automotive manufacturers and suppliers who wish to mount the radiating element on a window of a vehicle and still maintain good visibility for a driver through the glass.

The invention also provides a patch antenna including a radiating element formed of a conductive material and a plurality of feed lines electrically connected to the radiating element at a plurality of feed ports. At least one phase shift circuit is electrically connected to at least one of the plurality of feed lines for phase shifting a base signal to achieve a phase-shifted signal. The feed ports are spaced apart from one another such that the radiating element is excitable to generate a circularly polarized radiation beam in a higher order mode at a desired frequency. In this embodiment, the patch antenna also includes at least one parasitic structure disposed adjacent to the radiating element and separated from the radiating element.

The at least one parasitic structure also acts to tilt the radiation beam away from an axis perpendicular to the radiating element. Therefore, the patch antenna provides exceptional reception of circularly polarized RF signals from a satellite at a low elevation angle.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Referring to the Figures, wherein like numerals indicate corresponding parts throughout the several views, a patch antenna 20 is disclosed.

Preferably, the antenna 20 is utilized to receive a circularly polarized radio frequency (RF) signal from a satellite. Specifically, the antenna 20 is utilized to receive a left-hand circularly polarized (LHCP) RF signal like those produced by a Satellite Digital Audio Radio Service (SDARS) provider, such as XM® Satellite Radio or SIRIUS® Satellite Radio. However, those skilled in the art understand that the antenna 20 may also receive a right-hand circularly polarized (RHCP) RF signal. Furthermore, in addition to receiving the LCHP and/or RHCP RF signals, the antenna 20 may also be used to transmit the circularly polarized RF signal. The antenna 20 will be described hereafter mainly in terms of receiving the LHCP RF signal, but this should not be read as limiting in any way.

Figure 1:
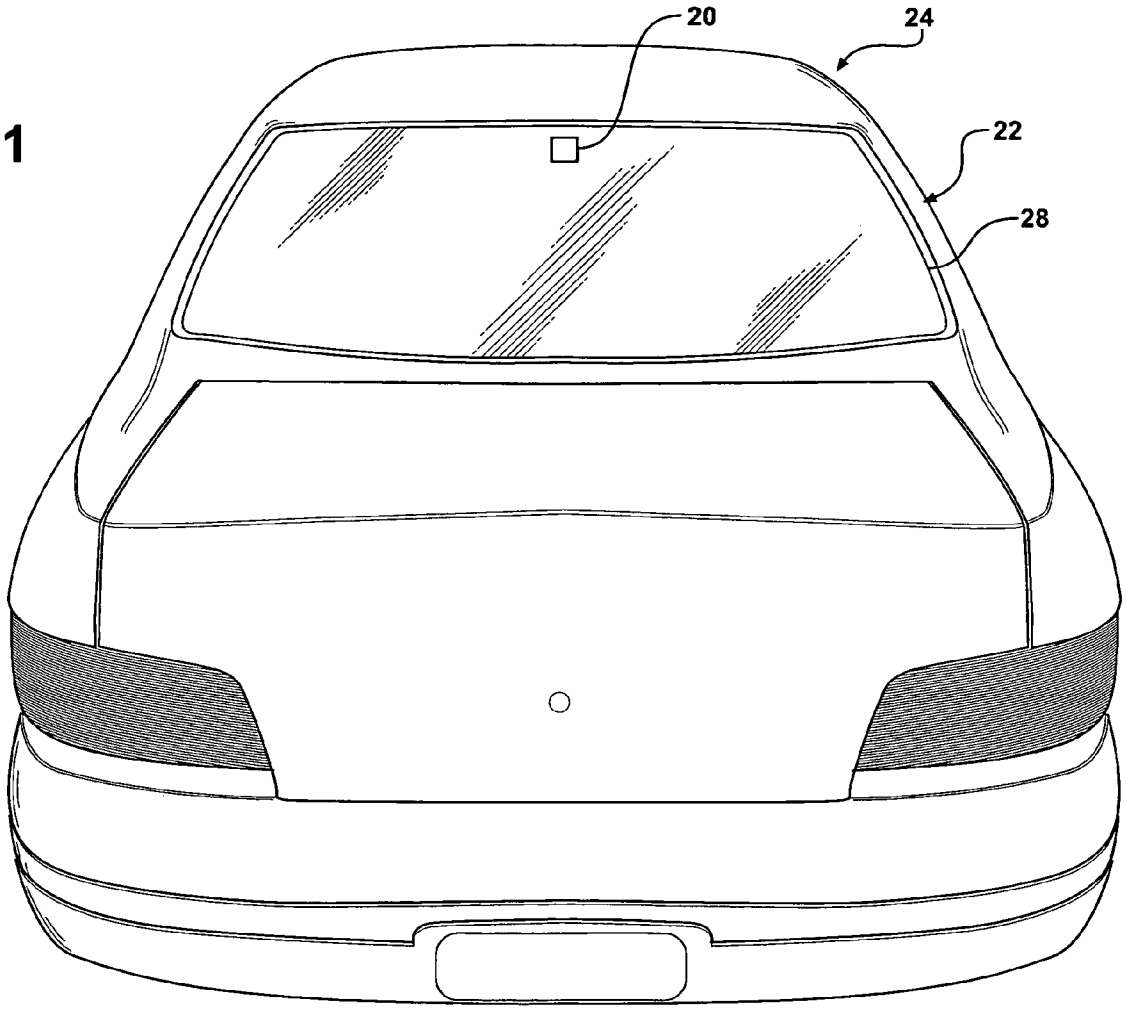
FIG. 1 is a perspective view a vehicle with a patch antenna supported by a pane of glass of the vehicle.

Referring to FIG. 1, the antenna 20 is preferably integrated with a window 22 of a vehicle 24. This window 22 may be a rear window (backlite), a front window (windshield), or any other window of the vehicle 24. Those skilled in the art realize that the antenna 20 as described herein may be located at other positions on the vehicle 24, such as on a sheet metal portion like the roof of the vehicle 24 or a side mirror of the vehicle 24. The antenna 20 may also be implemented in other situations completely separate from the vehicle 24, such as on a building or integrated with a radio receiver. The rear window 22 and the windshield are typically each disposed in the vehicle 24 at an angle, such that they define a surface that is not parallel to the ground (i.e., the surface of the Earth). Therefore, the antenna 20 disposed on these types of windows 22 is also not parallel to the ground.

The window 22 preferably includes at least one pane of glass 28. The pane of glass 28 is preferably automotive glass and more preferably soda-lime-silica glass, which is well known for use in panes of glass of vehicles 24. The pane of glass 28 functions as a radome to the antenna 20. That is, the pane of glass 28 protects the components of the antenna 20, as described in detail below, from moisture, wind, dust, etc. that are present outside the vehicle 24. The pane of glass 28 defines a thickness between 1.5 and 5.0 mm, preferably 3.1 mm. The pane of glass 28 also has a relative permittivity between 5 and 9, preferably 7. Of course, the window 22 may include more than one pane of glass 28. Those skilled in the art realize that automotive windows 22, particularly windshields, typically include two panes of glass sandwiching a layer of polyvinyl butyral (PVB).

Figure 2:
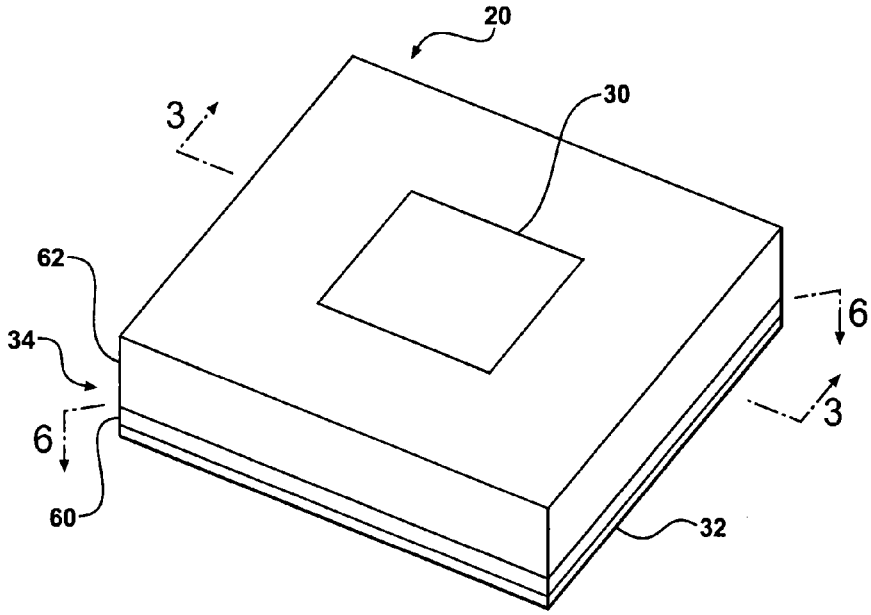
FIG. 2 is a perspective view of a first embodiment of the antenna unsupported by the pane of glass and showing a radiating element, a first dielectric layer, a second dielectric layer, and a ground plane.

Referring to FIG. 2, showing a first embodiment of the invention, the antenna 20 includes a radiating element 30 formed of an electrically conductive material as described below. The radiating element 30 is also commonly referred to by those skilled in the art as a "patch" or a "patch element". The radiating element 30 preferably defines a generally rectangular shape, specifically a square shape. Each side of the radiating element 30 measures about ¼ of an effective wavelength $\lambda$ of the RF signal to be received by the antenna 20. RF signals transmitted by SDARS providers typically have a frequency from 2.32 GHz to 2.345 GHz. Specifically, XM Radio broadcasts at a center frequency of 2.338 GHz. Therefore, each side of the radiating element 30 measures about 24 mm. However, those skilled in the art realize alternative embodiments where the radiating element 30 defines alternative shapes and sizes based on the desired frequency and other considerations.

The antenna 20 also includes a ground plane 32 formed of an electrically conductive material including, but not limited to, copper. The ground plane 32 is disposed substantially parallel to and spaced from the radiating element 30. It is preferred that the ground plane 32 also defines a generally rectangular shape, specifically a square shape. The ground plane 32 preferably measures about 60 mm×60 mm. However, the ground plane 32 may be implemented with various shapes and sizes.

At least one dielectric layer 34 is preferably disposed between the radiating element 30 and the ground plane 32. Said another way, the at least one dielectric layer 34 is sandwiched between the radiating element 30 and the ground plane 32. A preferred implementation of the at least one dielectric layer 34 is described in greater detail below.

Figure 3:
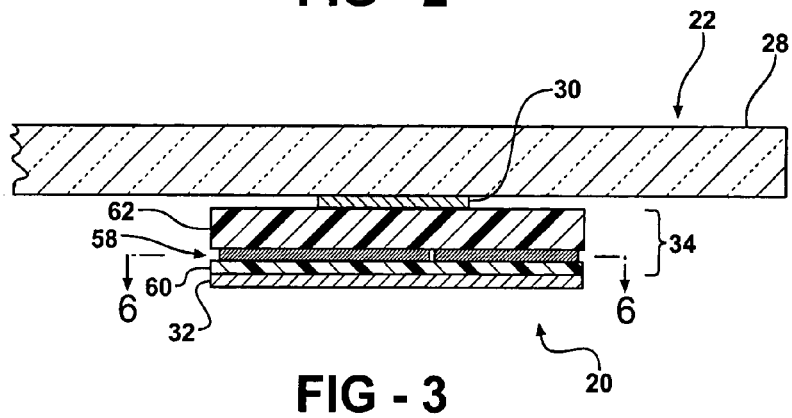
FIG. 3 is a cross-sectional view of the first embodiment of the antenna taken along line 3-3 in FIG. 2 with the radiating element disposed on the pane of glass and electromagnetic coupling of a feed line network to the radiating element.

In the first embodiment, as shown in FIG. 3, the pane of glass 28 of the window 22 supports the radiating element 30. The pane of glass 28 supports the radiating element 30 by the radiating element 30 being adhered, applied, or otherwise connected to the pane of glass 28. In the first and second embodiments, the radiating element 30 comprises a silver paste as the electrically conductive material which is disposed directly on the pane of glass 28 and hardened by a firing technique known to those skilled in the art. Alternatively, the radiating element 30 could comprise a flat piece of metal, such as copper or aluminum, adhered to the pane of glass 28 using an adhesive.

Figure 4:
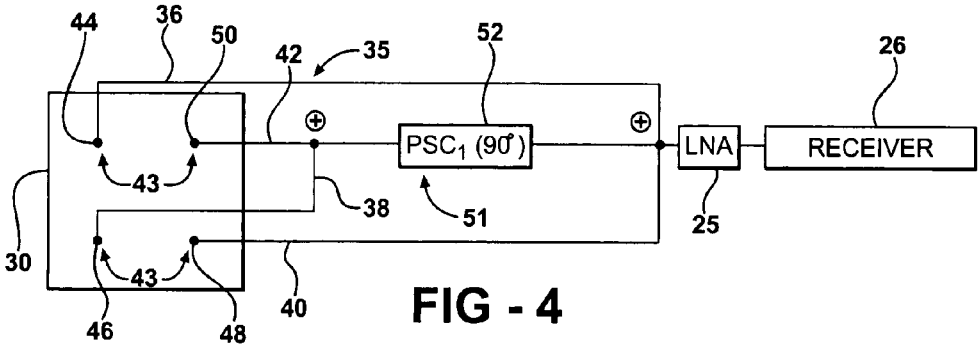
FIG. 4 is an electrical schematic block diagram of the first embodiment of the antenna showing the radiating element, a receiver, a low noise amplifier, a first phase shift circuit, and four feed lines.

Referring now to FIG. 4, the patch antenna 20 also includes a plurality of feed lines 35. Each feed line 35 is electrically connected to the radiating element 30 at a feed port 43. Each feed port 43 is defined as the end point, or terminus, of each feed line 35. In the first embodiment, the feed ports 43 are not in contact with the radiating element 30. Instead, the electrical connection is produced by electromagnetically coupling the feed port 43 and the radiating element 30. In other embodiments, such as the second embodiment described in more detail below, the feed ports 43 (and accordingly, the feed lines 35) may come into direct contact with the radiating element 30.

In the first embodiment, the antenna 20 is implemented with four feed lines 36, 38, 40, 42 electrically connected to the radiating element 30 at four feed ports 44, 46, 48, 50. Specifically, a first feed line 36 is electrically connected to the radiating element 30 at a first feed port 44, a second feed line 38 is electrically connected to the radiating element 30 at a second feed port 46, a third feed line 40 is electrically connected to the radiating element 30 at a third feed port 48, and a fourth feed line 42 is electrically connected to the radiating element 30 at a fourth feed port 50.

The feed ports 44, 46, 48, 50 of the first embodiment are disposed with relationship to one another such that the feed ports 44, 46, 48, 50 define corners of a square shape. Of course, the square shape is merely a hypothetical construct for easily showing the physical relationship between the feed ports 44, 46, 48, 50. Those skilled in the art realize that the feed ports 44, 46, 48, 50 of the preferred embodiment also define a circle shape with each feed port 44, 46, 48, 50 about equidistant along a periphery of the circle shape from adjacent feed ports 44, 46, 48, 50 and a diameter equal to the diagonals of the square shape. For ease in labeling, the feed ports 44, 46, 48, 50 are assigned sequentially counter-clockwise around the square or circle shape, staring in the upper left. For example, if the feed port 43 in the upper, left-hand corner of the square shape is the first feed port 44, then the second feed port 46 is in the lower, left-hand corner, the third feed port 48 is in the lower, right-hand corner, and the fourth feed port 50 is in the upper, right-hand corner.

Preferably, the antenna 20 also includes at least one phase shift circuit 51 for shifting the phase of a base signal. The base signal is provided to a low noise amplifier (LNA) 25 and/or a receiver 26 from the antenna 20. Alternatively, where the antenna 20 is used to transmit, the base signal is provided by a transmitter (not shown). The base signal, since it is not phase shifted, may be referred to as being offset by zero degrees (0°).

In the first embodiment, as shown in FIG. 4, the at least one phase shift circuit 51 is implemented as a first phase shift circuit 52. The first phase shift circuit 52 shifts the base signal by about ninety degrees (90°) to produce a first phase-shifted signal. Those skilled in the art realize that the 90° phase shift could vary by up to ten percent with little impact on overall performance. The first phase shift circuit 52 is electrically connected to the second feed line 38 and the fourth feed line 42, and thus, provides the first phase-shifted signal (90°) to the second feed port 46 and the fourth feed port 50. As a result, the first phase-shifted signal (90°) is applied at opposite corners of the square shape. The LNA 25 is electrically connected to the first feed line 36 and the third feed line 40. Thus, the base signal (0°) is applied to the first feed port 44 and the third feed port 48, also at opposite corners of the square shape. Application of the base signal and first phase-shifted signal in this manner produces a circularly polarized radiation beam. Those skilled in the art will realize alternate embodiments to produce the circularly polarized radiation beam using different configurations of phase shift circuits 51.

Preferably, the plurality of feed ports 43 are spaced apart from one another such that the radiating element 30 is excitable at the feed ports 43 to generate a circularly polarized radiation beam solely in a higher order mode at a desired frequency. Said another way, the circularly polarized radiation beam is not generated in a fundamental mode, but only in the higher order mode. That is, the operating mode of the antenna 20 consists of a higher order mode. The higher order mode is preferably a transverse magnetic mode. More preferably, the higher order mode is a TM22 mode. However, those skilled in the art realize that the other higher order modes besides the TM22 mode may achieve acceptable results. Furthermore, in other embodiments, the radiation beam may also be generated in both the higher order and fundamental modes.

Generating the circularly polarized radiation beam solely in a higher order mode is accomplished due to the application of the base signal and the phase-shifted signals to the radiating element 30 along with the spacing of the feed ports 43 with respect to one another. In the first and second embodiments, each side of the square shape defined by the feed ports 44, 46, 48, 50 measures about 16.6 mm. Said another way, each feed port 44, 46, 48, 50 is separated from two other feed ports 44, 46, 48, 50 by about 16.6 mm, and consequently, separated from the diagonally-opposed feed port 44, 46, 48, 50 by about 23.5 mm. These measurements are dependent on the desired operating frequency of the antenna 20, which, in the preferred embodiment, is about 2.338 GHz. Within the teaching of the present invention, the dimensions may be modified by one skilled in the art for alternative operating frequencies.

Figure 5:
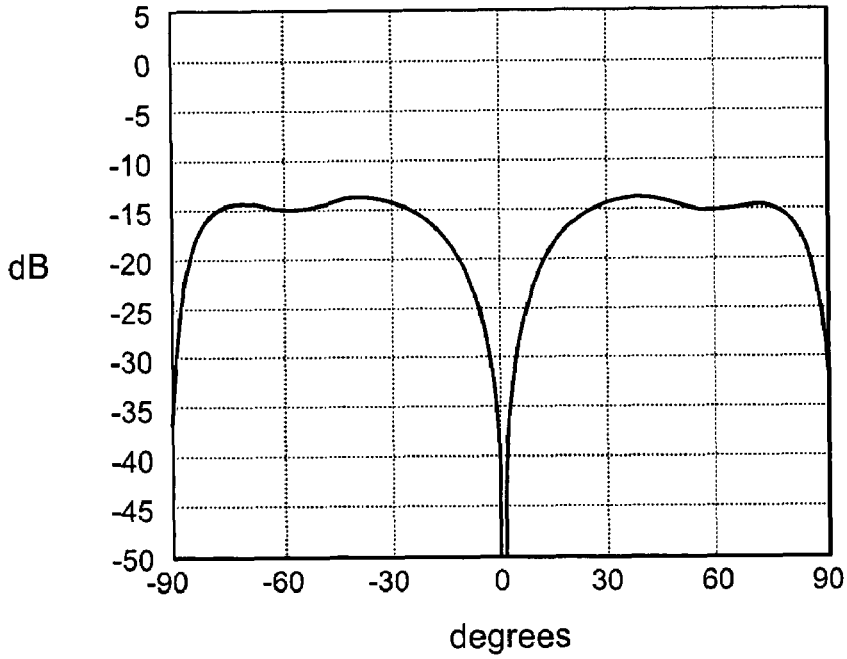
FIG. 5 is a chart showing a pattern of a left hand circularly polarized radiation beam resulting from operation of the first embodiment of the antenna.

In the first and second embodiments, when the radiation beam is generated, a null is established in the LHCP radiation beam at an axis perpendicular to the radiating element 30. Said another way, the pattern of the radiation beam shows a null in the broadside direction as is shown in FIG. 5. More importantly, the maximum gain of the LHCP radiation beam is about 40-50 degrees offset the axis perpendicular to the radiating element 30. Thus, the LHCP radiation beam is "tilted" (or "steered".) This tilting-effect is very beneficial when attempting to receive the LHCP RF signals from a satellite at a low elevation angle, e.g., an XM radio satellite. Furthermore, the dimensions of the radiating element 30 are much smaller than many prior art radiating elements 30. This is very desirous to automotive manufacturers and suppliers who wish to lessen the amount of obstruction on the windows 22 of the vehicle 24. Additionally, the use of less conductive material in the radiating element 30 may also reduce manufacturing costs.

Referring again to FIG. 2, in the first and second embodiments, the at least one dielectric layer 34 is implemented as a first dielectric layer 60 and a second dielectric layer 62. The first dielectric layer 60 is in contact with the ground plane 32. The second dielectric layer 62 is in contact with the radiating element 30. Preferably, the first and second dielectric layers 60, 62 are at least partially in contact with one another. The first dielectric layer 60 has a dielectric constant of about 4.5 and a width of about 1.524 mm. The second dielectric layer 62 also has a dielectric constant of about 4.5 but has a width of about 5.0 mm. Thus, the spacing between the ground plane 32 and the radiating element 30 is about 6.524 mm.

Figure 7:
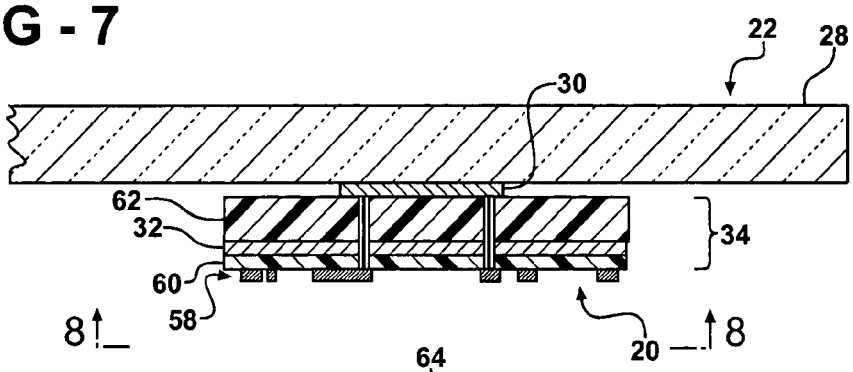
FIG. 7 is a cross-sectional view of a second embodiment of the antenna with the ground plane disposed between the dielectric layers and direct electrical connection of the feed line network to the radiating element.
Figure 8:
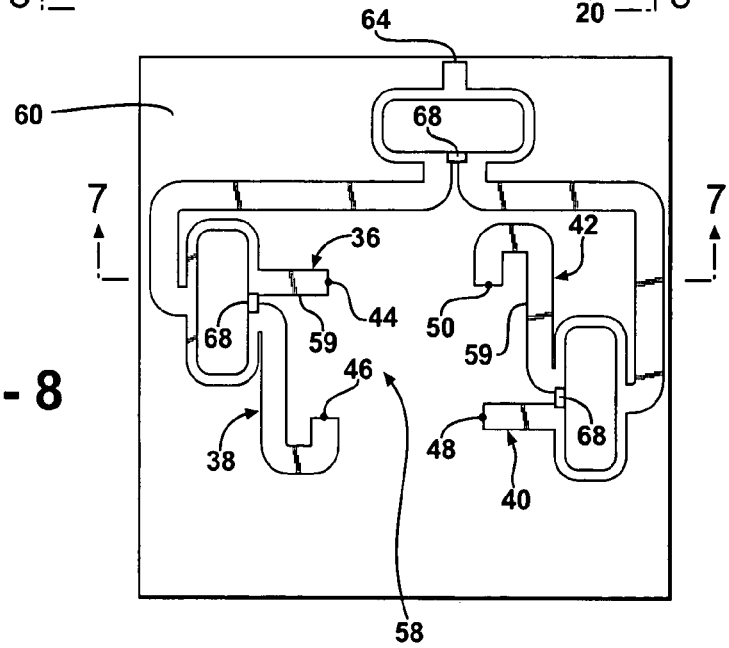
FIG. 8 is a bottom view of the second embodiment of the antenna taken along line 8-8 in FIG. 7 and showing a feed line network disposed on the second dielectric layer.

FIGS. 7 and 8 show the second embodiment where there is a direct connection between the feed lines 36, 38, 40, 42 and the radiating element 30. In this embodiment, the ground plane 32 is sandwiched between the first and second dielectric layers 60, 62. The feed line network 58 is disposed on the first dielectric layer 60 on the opposite side from the ground plane 32. A plurality of pins 64 electrically connect the feed lines to the radiating element 30. Passage holes (not numbered) are defined in the ground plane 32 to prevent an electrical connection between the feed lines 36, 38, 40, 42 and the ground plane 32.

In both the first and second embodiments, the feed line network 58 is also utilized to shift the phase of a signal applied to the feed lines 36, 38, 40, 42, thus, acting as the phase shift circuits 51 described above. This phase shifting is accomplished due to the inductive and capacitive properties of the conductive strips 59 of the feed line network 58. The inductive and capacitive properties of the conductive strips 59 are determined by the impedance and length of each conductive strip 59. The impedance of each conductive strip 59 is determined by the frequency of operation, the width of each conductive strip 59, the dielectric constant of the first dielectric layer 60, and the distance between the conductive strips 59 and the ground plane 32.

In the described embodiments, a conductive strip 59 width of about 1/60 of the effective wavelength yields an impedance of about 70.71 ohms and a width of about 1/35 of the effective wavelength yields an impedance of about 50 ohms.

Figure 6:
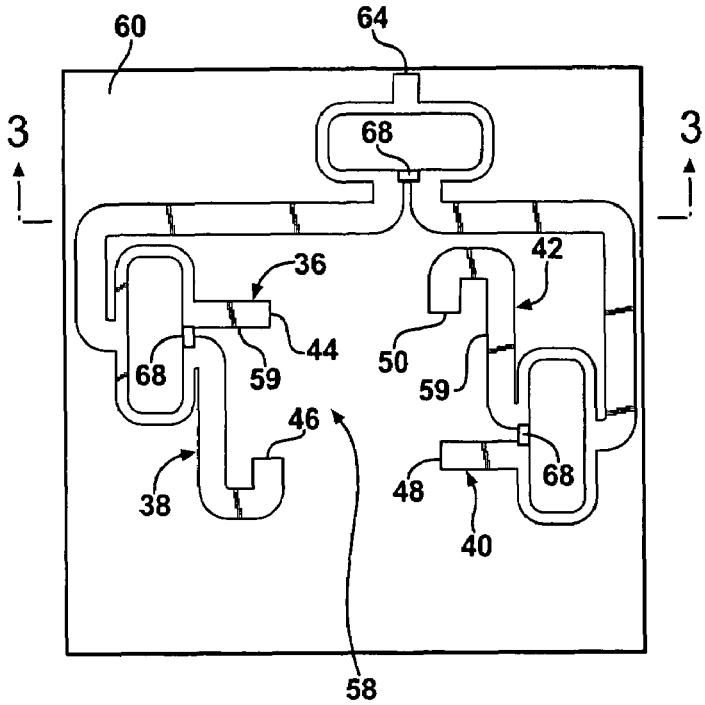
FIG. 6 is a cross-sectional view of the first embodiment of the antenna taken along line 6-6 in FIG. 3 and showing a feed line network disposed on the second dielectric layer.

The feed line network 58 shown in FIGS. 6 and 8 implement the 0°, 90°, 0°, and 90° phase shifts. As can be seen, the conductive strips 59 form divergent paths which alternate between the various widths. Resistors 68 electrically connect between the divergent paths to ensure that an equal amount power is carried to or from each feed line port 44, 46, 48, 50. Those skilled in the art realize that the feed line network 58 could be designed to perform other phase shifts or in a manner that does not perform any phase shifts.

Figure 9:
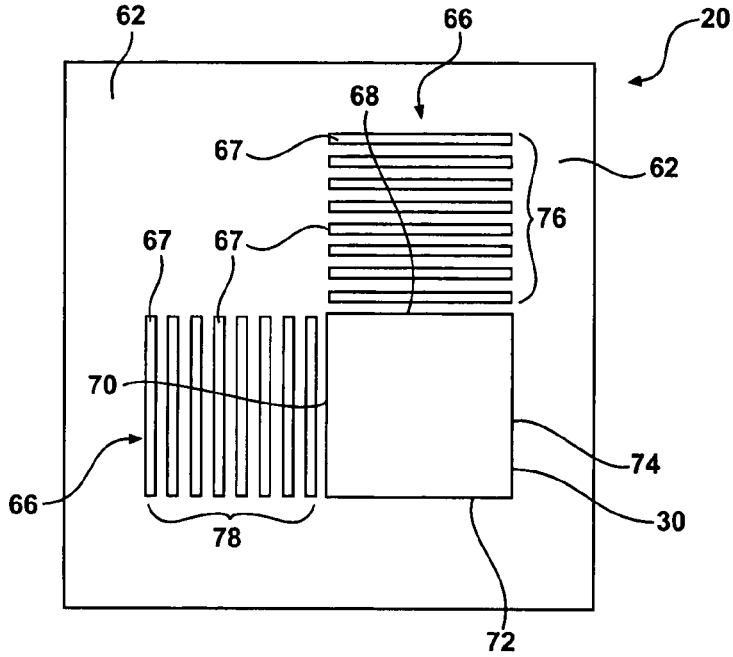
FIG. 9 is a top view of a third embodiment of the antenna showing the radiating element, the first dielectric layer, and a first configuration of parasitic elements.

The antenna 20 may also include at least one parasitic structure 66 for further directing and/or tilting the radiation beam. Referring now to FIG. 9, which shows a third embodiment of the invention, the parasitic structure 66 is disposed adjacent to the radiating element 30 and separated from the radiating element 30. Said another way, the parasitic structure 66 is not in direct contact with the radiating element 30. However, the proximity of the parasitic structure 66 with the radiating element 30 affects the radiating beam. Preferably, the parasitic structure 66 is disposed substantially co-planar with the radiating element 30. It is also preferred that each of the parasitic structures 66 includes a plurality of strips 67 formed of an electrically conductive material. However, those skilled in the art realize other techniques for forming the parasitic structures 66, other than the preferred plurality of strips 67.

As stated above, the radiating element 30 defines a generally rectangular shape and preferably a square shape. The radiating element 30, therefore, defines fours sides: a first side 68, a second side 70, a third side 72, and a fourth side 74. These sides 68, 70, 72, 74 are sequentially situated around the radiating element 30 such that the first side 68 is disposed opposite the third side 72 and the second side 70 is disposed opposite the fourth side 74. The numbering of the sides 68, 70, 72, 74 is done for convenience purposes only to assist with relationship between the radiating element 30, parasitic structures 66, and other components of the antenna 20. Those skilled in the art realize other ways of labeling the sides of the radiating element 30.

The at least one parasitic structure 66 may be implemented as a first parasitic structure 76 and a second parasitic structure 78. The first parasitic structure 76 is disposed adjacent one of the sides 68, 70, 72, 74 of the radiating element 30 and the second parasitic structure 78 disposed adjacent another of the sides 70, 72, 74, 68 of the radiating element 30. In the third embodiment, the first parasitic structure 76 is disposed adjacent the first side 68 and the second parasitic structure 78 is disposed adjacent the second side 70. The strips 67 of the third embodiment are disposed spaced from and substantially parallel to one another. The strips 67 preferably have a length about equal to a length of each side 68, 70, 72, 74 of the radiating element 30.

Figure 10:
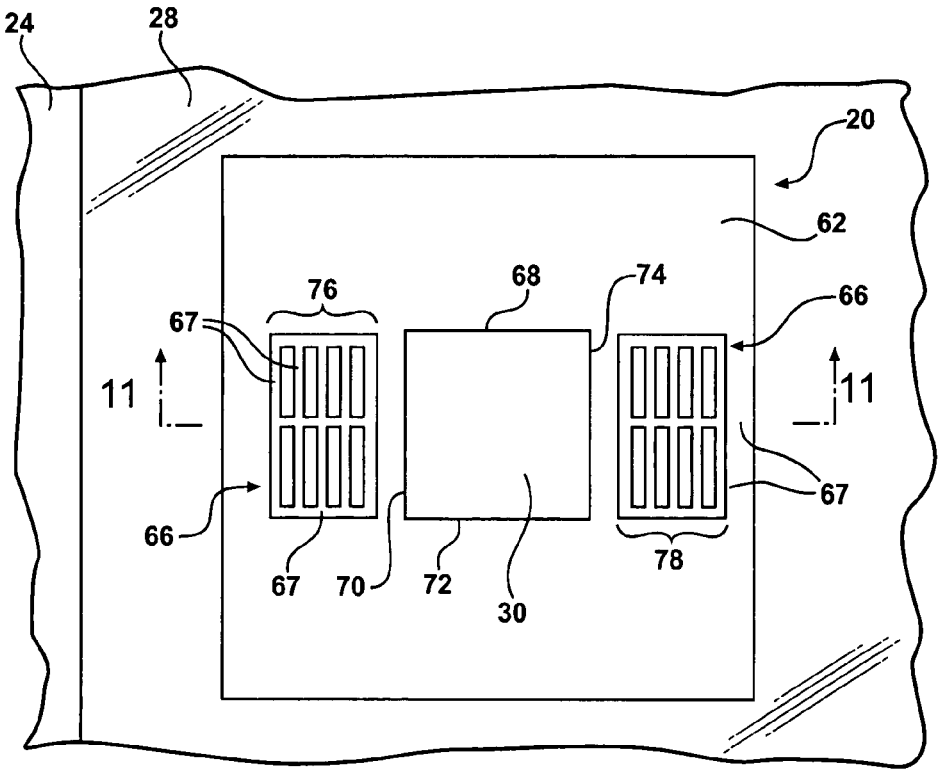
FIG. 10 is a top view of a fourth embodiment of the antenna showing the radiating element, the first dielectric layer, and a second configuration of parasitic elements.
Figure 11:
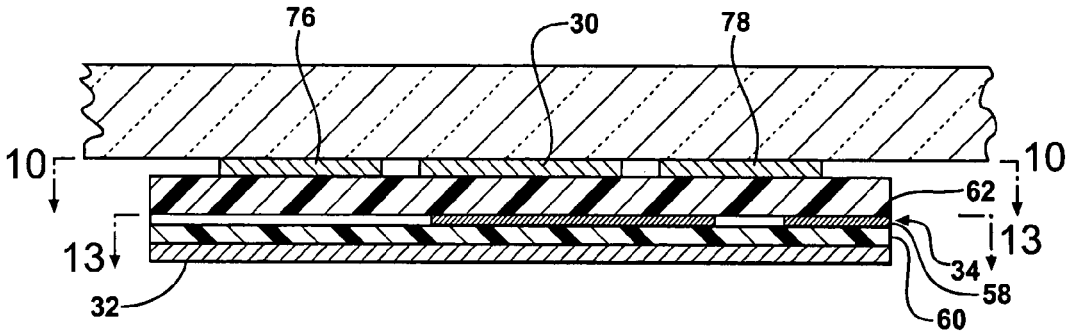
FIG. 11 is a cross-sectional view of the fourth embodiment of the antenna taken along line 11-11 in FIG. 10.

In a fourth embodiment, as shown in FIGS. 10 and 11, the first parasitic structure 76 is disposed adjacent the second side 70 of the radiating element 30 and the second parasitic structure 78 is disposed adjacent the fourth side 74. Thus, the parasitic structures 76, 78 are disposed on opposite sides 70, 74 of the radiating element 30. Similar to the third embodiment, each parasitic structure 76, 78 includes the plurality of strips 67. However, in the fourth embodiment, at least two of the strips 67 are defined as parallel strips (not numbered) which are spaced from and substantially parallel to one another and at least one of the strips 67 is further defined as a perpendicular strip (not numbered) disposed perpendicular to the parallel strips and in contact with the parallel strips. Furthermore, in implementing the fourth embodiment in the vehicle 24, it is preferred that the one of the parasitic structures 76, 78 is immediately adjacent to the roof of the vehicle 24, as shown in FIG. 10. Said another way, the parasitic structures 76, 78 and the radiating element 30 form an axis that is generally perpendicular to an axis formed by the roof. This configuration allows the resulting radiation beam to be tilted such that a maximum radiation pattern is generated above the roof.

Figure 12:
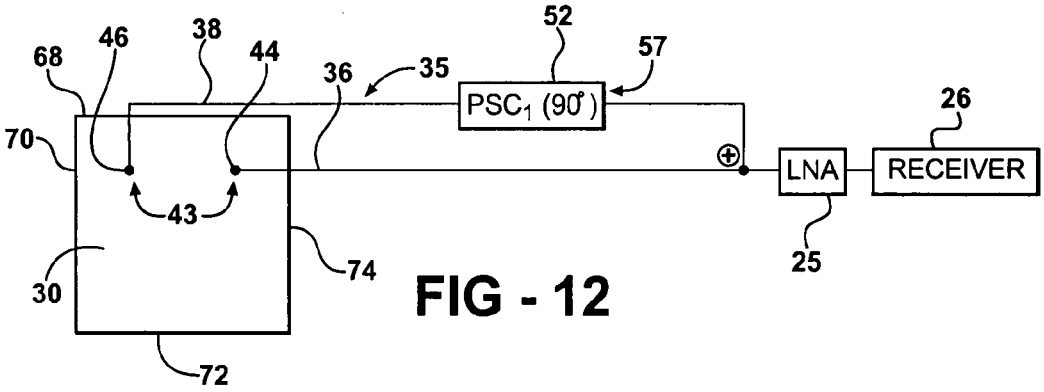
FIG. 12 is an electrical schematic block diagram of the third and fourth embodiments of the antenna showing the radiating element, the receiver, the first phase shift circuit, and two feed lines.

Referring now to FIG. 12, in the third and fourth embodiments, the feed lines 35 are a pair of feed lines: the first feed line 36 and the second feed line 38. The first feed line 36 is electrically connected to the radiating element 30 at the first feed port 44 and the second feed line 38 is electrically connected to the radiating element 30 at the second feed port 46. The first and second feed ports 44, 46 are separated by about 1/6 of the effective wavelength (16.6 mm when the desired frequency is about 2.338 GHz). This separation allows the generation of the circularly polarized radiation beam solely in a higher order mode at the desired frequency. Within the teaching of the present invention, the dimensions may be modified by one skilled in the art for alternative operating frequencies. Furthermore, the dimensions may also be modified by one skilled in the art for generating a circularly polarized radiation beam in both the fundamental mode and a higher order mode.

Figure 13:
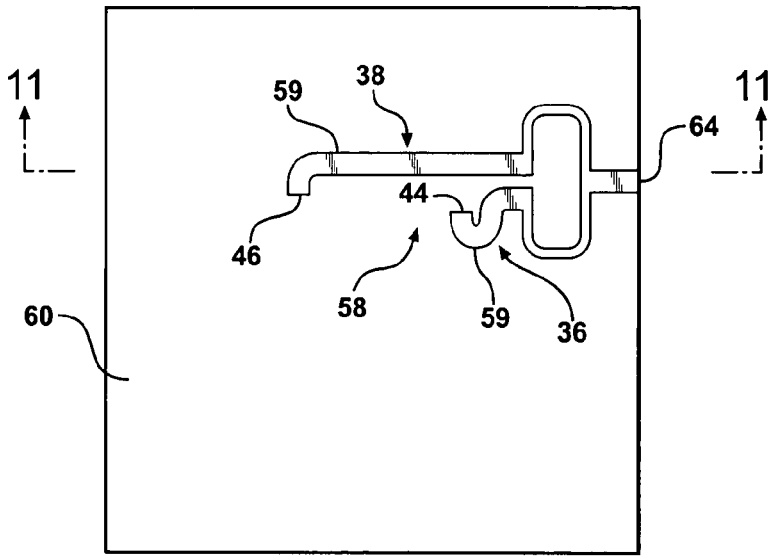
FIG. 13 is a top view of the second dielectric layer of the third and fourth embodiments of the antenna taken along lines 13-13 in FIG. 11 and showing the feed line network.
Figure 14:
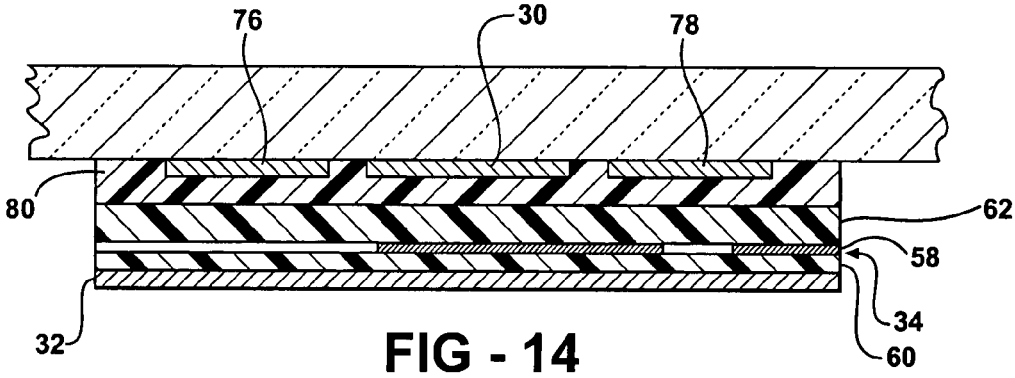
FIG. 14 is a cross-sectional view of the fourth embodiment of the antenna including a third dielectric layer disposed between the pane of glass and the first dielectric layer.

In the third and fourth embodiments, the at least one phase shift circuit 51 is implemented as the first phase shift circuit 52. The first phase shift circuit 52 shifts the base signal by about 90 degrees to produce the first phase-shifted signal. The first phase shift circuit 52 is electrically connected to the second feed line 38 and provides the first phase-shifted signal to the second feed port 46. As shown in FIG. 14, the antenna 20 of the third and fourth embodiments includes the feed line network 58 sandwiched between the first and second dielectric layers 60, 62 to implement the first phase shift circuit 52. Referring to FIG. 13, the length, width, and spacing of the second feed line 38 provides the 90 degree phase shift. The feed line network 68 also includes the input port 64 which may be electrically connected to the low noise amplifier 25 and/or the receiver 26.

Referring to FIG. 14, the antenna 20 may be implemented with a third dielectric layer 80 sandwiched between the second dielectric layer 80 and the pane of glass 28. The third dielectric layer 80 is preferably formed of a non-rigid gel or other non-rigid substance as known to those skilled in the art. Since the pane of glass 28 typically has a slight curvature to its surfaces, the third dielectric layer 80 eliminates air gaps between the pane of glass 28 and the second dielectric layer 62.

Those skilled in the art realize that many of the Figures are not drawn to scale. This is particularly evident in the cross-sectional representations of the various embodiments of the antenna 10 in FIGS. 3, 7, 11, and 14. Particularly, in these Figures, the width of the electrically conductive components, such as the radiating element 30, the ground plane 32, the feed line network 58, and the parasitic structures 76, 78, is exaggerated such that it may be seen from the cross-sectional view. Those skilled in the art also realize that the width of these electrically conductive components may be much less than 1 mm and therefore difficult to perceive from an actual cross-sectional view of the antenna.

The present invention has been described herein in an illustrative manner, and it is to be understood that the terminology which has been used is intended to be in the nature of words of description rather than of limitation. Obviously, many modifications and variations of the invention are possible in light of the above teachings. The invention may be practiced otherwise than as specifically described within the scope of the appended claims.

What is claimed is:

1. A patch antenna comprising:

a radiating element formed of a conductive material;

a plurality of feed lines electrically connected to said radiating element at a plurality of feed ports;

at least one phase shift circuit electrically connected to at least one of said plurality of feed lines for phase shifting a base signal to achieve a phase-shifted signal; and said plurality of feed ports spaced apart from one another such that said radiating element is excitable at said feed ports to generate a circularly polarized radiation beam solely in a higher order mode at a desired frequency.

2. A patch antenna as set forth in claim 1 further comprising at least one parasitic structure disposed adjacent to said radiating element and separate from said radiating element.

3. A patch antenna as set forth in claim 2 wherein said parasitic structure is disposed substantially co-planar with said radiating element.

4. A patch antenna as set forth in claim 2 wherein said radiating element defines a generally rectangular shape having a first side, a second side, a third side, and a fourth side sequentially situated such that said first side is disposed opposite said third side and said second side is disposed opposite said fourth side.

5. A patch antenna as set forth in claim 4 wherein said at least one parasitic structure is further defined as a first parasitic structure and a second parasitic structure with said first parasitic structure disposed adjacent one of said sides and said second parasitic structure disposed adjacent another of said sides.

6. A patch antenna as set forth in claim 5 wherein said first parasitic structure is disposed adjacent said first side and said second parasitic structure is disposed adjacent said second side.

7. A patch antenna as set forth in claim 5 wherein said first parasitic structure is disposed adjacent said first side and said second parasitic structure is disposed adjacent said third side.

8. A patch antenna as set forth in claim 2 wherein each of said at least one parasitic structures includes a plurality of strips formed of a conductive material.

9. A patch antenna as set forth in claim 8 wherein said strips are disposed spaced from and substantially parallel to one another.

10. A patch antenna as set forth in claim 8 wherein at least two of said strips are further defined as parallel strips which are disposed spaced from and substantially parallel to one another and wherein at least one of said strips is further defined as a perpendicular strip disposed perpendicular to said parallel strips and in contact with said parallel strips.

11. A patch antenna as set forth in claim 2 wherein said feed lines are further defined as a first feed line electrically connected to said radiating element at a first feed port and a second feed line electrically connected to said radiating element at a second feed port.

12. A patch antenna as set forth in claim 11 wherein said first and second feed ports are separated by about ⅙ of an effective wavelength of said antenna.

13. A patch antenna as set forth in claim 11 wherein said at least one phase shift circuit is further defined as a first phase shift circuit for shifting the base signal by about 90 degrees to produce a first phase-shifted signal.

14. A patch antenna as set forth in claim 13 wherein said first phase shift circuit is electrically connected to said second feed line for providing the first phase-shifted signal to said second feed port.

15. A patch antenna as set forth in claim 1 wherein said feed lines are further defined as a first feed line electrically connected to said radiating element at a first feed port, a second feed line electrically connected to said radiating element at a second feed port, a third feed line electrically connected to said radiating element at a third feed port, and a fourth feed line electrically connected to said radiating element at a fourth feed port.

16. A patch antenna as set forth in claim 15 wherein each of said feed ports defines a corner of a square shape and each side of said square shape measures about ⅙ of an effective wavelength of said antenna.

17. A patch antenna as set forth in claim 16 wherein said at least one phase shift circuit is further defined as a first phase shift circuit for shifting the base signal by about 90 degrees to produce a first phase-shifted signal.

18. A patch antenna as set forth in claim 17 wherein said second and fourth feed ports are diagonally opposite one another and said first phase shift circuit is electrically connected to said second and fourth feed lines for providing the first phase-shifted signal to said second and fourth feed ports.

19. A patch antenna as set forth in claim 16 wherein said at least one phase shift circuit is further defined as a first phase shift circuit for shifting the base signal by about 90 degrees, a second phase shift circuit for shifting the base signal by about 180 degrees, and a third phase shift circuit for shifting the base signal by about 270 degrees.

20. A patch antenna as set forth in claim 19 wherein said feed ports are sequentially arranged about the square shape and said first phase shift circuit is electrically connected to said second feed line for providing the first phase-shifted signal to said second feed port, said second phase shift circuit is electrically connected to said third feed line for providing the second phase-shifted signal to said third feed port, and said third phase shift circuit is electrically connected to said fourth feed line for providing the third phase-shifted signal to said fourth feed port.

21. A patch antenna comprising:

a radiating element formed of a conductive material;

a plurality of feed lines electrically connected to said radiating element at a plurality of feed ports;

at least one phase shift circuit electrically connected to at least one of said plurality of feed lines for phase shifting a base signal to achieve a phase-shifted signal;

said radiating element excitable at said plurality of feed ports to generate a circularly polarized radiation beam in a higher order mode at a desired frequency; and at least one parasitic structure disposed adjacent to said radiating element and separated from said radiating element.

22. A patch antenna as set forth in claim 21 wherein said radiating element defines a generally rectangular shape having a first side, a second side, a third side, and a fourth side sequentially situated such that said first side is disposed opposite said third side and said second side is disposed opposite said fourth side.

23. A patch antenna as set forth in claim 22 wherein said at least one parasitic structure is further defined as a first parasitic structure and a second parasitic structure with said first parasitic structure disposed adjacent one of said sides and said second parasitic structure disposed adjacent another of said sides.

24. A patch antenna as set forth in claim 23 wherein said first parasitic structure is disposed adjacent said first side and said second parasitic structure is disposed adjacent said second side.

25. A patch antenna as set forth in claim 23 wherein said first parasitic structure is disposed adjacent said first side and said second parasitic structure is disposed adjacent said third side.

26. A patch antenna as set forth in claim 22 wherein each of said at least one parasitic structures includes a plurality of strips formed of a conductive material.

27. A patch antenna as set forth in claim 26 wherein said strips are disposed spaced from and substantially parallel to one another.

28. A patch antenna as set forth in claim 26 wherein at least two of said strips are further defined as parallel strips which are disposed spaced from and substantially parallel to one another and wherein at least one of said strips is further defined as a perpendicular strip disposed perpendicular to said parallel strips and in contact with said parallel strips.

29. A window having an integrated patch antenna, said window comprising:

a pane of glass;

a radiating element supported by said pane of glass and formed of a conductive material;

a plurality of feed lines electrically connected to said radiating element at a plurality of feed ports;

at least one phase shift circuit electrically connected to at least one of said plurality of feed lines for phase shifting a base signal to achieve a phase-shifted signal; and said plurality of feed ports spaced apart from one another such that said radiating element is excitable at said feed ports to generate a circularly polarized radiation beam solely in a higher order mode at a desired frequency.

30. A patch antenna as set forth in claim 29 further comprising at least one parasitic structure disposed adjacent to said radiating element and separated from said radiating element.

31. A window as set forth in claim 29 wherein said pane of glass is further defined as automotive glass.

32. A window as set forth in claim 31 wherein said pane of glass is further defined as soda-lime-silica glass.

* * * * *